US005955998A

United States Patent [19]

Roberts et al.

[11] Patent Number: 5,955,998

[45] Date of Patent: Sep. 21, 1999

[54] ELECTRONICALLY SCANNED FERRITE LINE SOURCE

[75] Inventors: Roger G. Roberts, Auburn; Wyman L. Williams, Duluth; Jeff M. Alexander, Clarkston, all of Ga.

[73] Assignee: EMS Technologies, Inc., Norcross, Ga.

[21] Appl. No.: 08/583,707

[22] Filed: Jan. 5, 1996

Related U.S. Application Data

[60] Provisional application No. 60/002,282, Aug. 14, 1995.

[51] Int. Cl.[6] ..... H01Q 13/10

[52] U.S. Cl. ..... 343/768; 343/771

[58] Field of Search ..... 343/768, 770, 343/771, 853; 342/371, 374; 333/24.1; H01Q 13/10

[56] References Cited

U.S. PATENT DOCUMENTS

| | | | |
|---|---|---|---|
| 3,698,008 | 10/1972 | Roberts et al. | 333/21 A |
| 3,855,597 | 12/1974 | Carlise | 343/768 |
| 4,613,869 | 9/1986 | Ajioka et al. | 343/768 |
| 4,768,001 | 8/1988 | Chan-Son-Lint et al. | 343/771 |
| 4,785,304 | 11/1988 | Stern et al. | 343/771 |
| 4,884,045 | 11/1989 | Alverson et al. | 333/158 |
| 5,075,648 | 12/1991 | Roberts et al. | 333/128 |
| 5,170,138 | 12/1992 | Roberts et al. | 333/24.1 |

*Primary Examiner*—Michael C. Wimer
*Attorney, Agent, or Firm*—Nixon & Vanderhye P.C.

[57] ABSTRACT

A ferrite scanning line source is formed of a ferrite toroid and one or more dielectric slabs mounted to a side of the toroid. A signal propagating through the waveguide is phase shifted by the magnetization of the toroid. The further down the toroid the signal propagates the greater the phase shift that is applied to the signal. Radiators or coupling ports are formed by slots cut in a wall of the waveguide. The phase of the signal radiating from each slot in the line source is shifted from the signals emanating from the preceding and following slot in the line source. By properly locating the slots along the line source, a composite beam formed by the energy radiating from each slot may be titled (scanned) to a desired direction. In addition, the amount of phase shift applied to the signal by the waveguide depends on the magnetic state of the phase shifter. By changing the magnetic state of the phase shifter, by using a latch wire, the direction of the beam emanating from the line source can be scanned, such as by ±20°. Phased array antenna systems are formed of groups of radiating elevation line sources that are fed signals by a group of azimuth line sources coupled by microstrips to the elevation line sources.

25 Claims, 8 Drawing Sheets

ELECTRONICALLY SCANNED FERRITE LINE SOURCE

This application claim the benefit of U.S. Provisional Application No. 60/002,282, filed Aug. 14, 1995.

FIELD OF THE INVENTION

This invention relates generally to low cost electronically scanned phased array antennas. The invention has particular applicability to electrically scanned antennas operating at high frequencies, such as in the microwave and millimeter wave frequency regions.

BACKGROUND OF THE INVENTION

A ferrite scanning line source is a linear ferrite loaded waveguide having a series of radiating apertures regularly spaced along the length of the waveguide. These line sources, in the past, have been formed from cylindrical columns of solid phase shifting ferrite material having a conductive sheath and a series of radiating apertures. Planar array antennas were formed by arranging several of these columns of scanning line sources in an array to form the antenna.

Conventional phase scanning antennas generally required thousands of radiating elements with associated connectors, power dividers, phase shifters, phase shifter drivers and transmission lines. Due to the smallness of antennas of the high microwave and millimeter wave frequencies, the radiating elements and other associated components are small and difficult to fabricate. For this reason, a ferrite scanning line source greatly simplifies a phased array antenna. An example of a conventional ferrite scanning line source is disclosed in U.S. Pat. No. 4,613,869, entitled "Electronically Scanned Array Antenna". Conventional ferrite scanning line sources have been large, inefficient or the coupling valves have been unstable with magnetization. Accordingly, there has been a long-felt need for a more compact and efficient ferrite scanning line source in which the RF H field at the coupling slots has minimum variation with phase state, and therefore minimum coupling value variation with scan angle.

Small high performance phase shifters have been recently developed for use in antennas operating in the microwave and millimeter wave frequency range. Examples of these phase shifters, known as hybrid mode phase shifters, are disclosed in commonly-assigned U.S. Pat. Nos. 5,075,648 and 5,170,138, both of which are incorporated by reference. Hybrid mode phase shifters have principally been applied as components to individual antenna radiator elements for phased array antennas. Individual radiator elements each having a hybrid mode phase shifter and an electronic driver are more complex and expensive than a ferrite scanning line source. Prior to the present invention, it was unknown how to minimize the RF H field variation at the coupling slots with variation in the scan angle when utilizing the transverse magnetized toroidal phase shifter (i.e., hybrid mode phasers) for ferrite scanning line sources. In addition, prior to the current invention, it was unknown how to solve the multiple reflection problems associated with radiating aperture and coupling slot impedance mismatches.

SUMMARY OF THE INVENTION

The present invention is a ferrite scanning line source formed of a ferrite toroid and one or more dielectric slabs mounted to a side of the toroid. The toroid and dielectric slabs are metalized around their perimeter to form the waveguide. A signal propagating through the waveguide is phase shifted by the magnetization of the toroid. The further down the toroid the signal propagates the greater the phase shift that is applied to the signal. The RF H field is relatively strong at the sidewall of the waveguide where the dielectric slab is located such that the currents induced by the signal in the waveguide are particularly strong at the sidewall adjacent the dielectric slab. Radiators are formed by etching slots in the metalized waveguide wall. Energy radiates from these coupling slots because the waveguide sidewall currents, due to the RF H field, creates a voltage difference across each slot. The coupling through the slots from the waveguide can be high because of the relatively strong currents at the sidewall having the dielectric slab and slots.

The phase of the signal radiating from each slot in the line source is shifted from the preceding slot in the line source. By properly locating the slots along the line source, the composite beam formed by the energy radiating from each slot may be tilted (scanned) to a desired direction. In addition, the amount of phase shift applied to the signal by the ferrite loaded waveguide depends on the magnetic state of the toroid. By using a latch wire to change the magnetic state of the toroid, the direction of the beam emanating from the line source can be scanned, such as by ±20°. A scanning phased array antenna can be formed by arranging the ferrite scanning line sources into a planar array.

The ferrite line sources may radiate directly to free space by using their slots to radiate energy from the line source. Similarly, the line sources may be coupled to microstrip lines to feed other antenna radiating elements. In one configuration, a planar array of ferrite line sources with radiating slots is applied to scan a beam through an elevation scan angle. These elevation line sources are selectively fed beam signals from an azimuth line source. In particular, each slot of the azimuth line source feeds one of the elevation line sources. This configuration provides both azimuth and elevation scan coverage. More than one azimuth line source could be used with an appropriate power divider network to provide multiple simultaneous beams. A scanning beam would be formed in the azimuth plane for each azimuth line source used. This is an attractive scheme to obtain aperture reuse. Each beam utilizes the entire aperture to obtain the required beam width and gain.

BRIEF DESCRIPTION OF THE DRAWINGS

The objectives, advantages and features of the invention will become more apparent from the following description that includes the accompanying drawings and detailed written description. In the drawings.

DETAILED DESCRIPTION OF THE DRAWINGS

Figure 1:
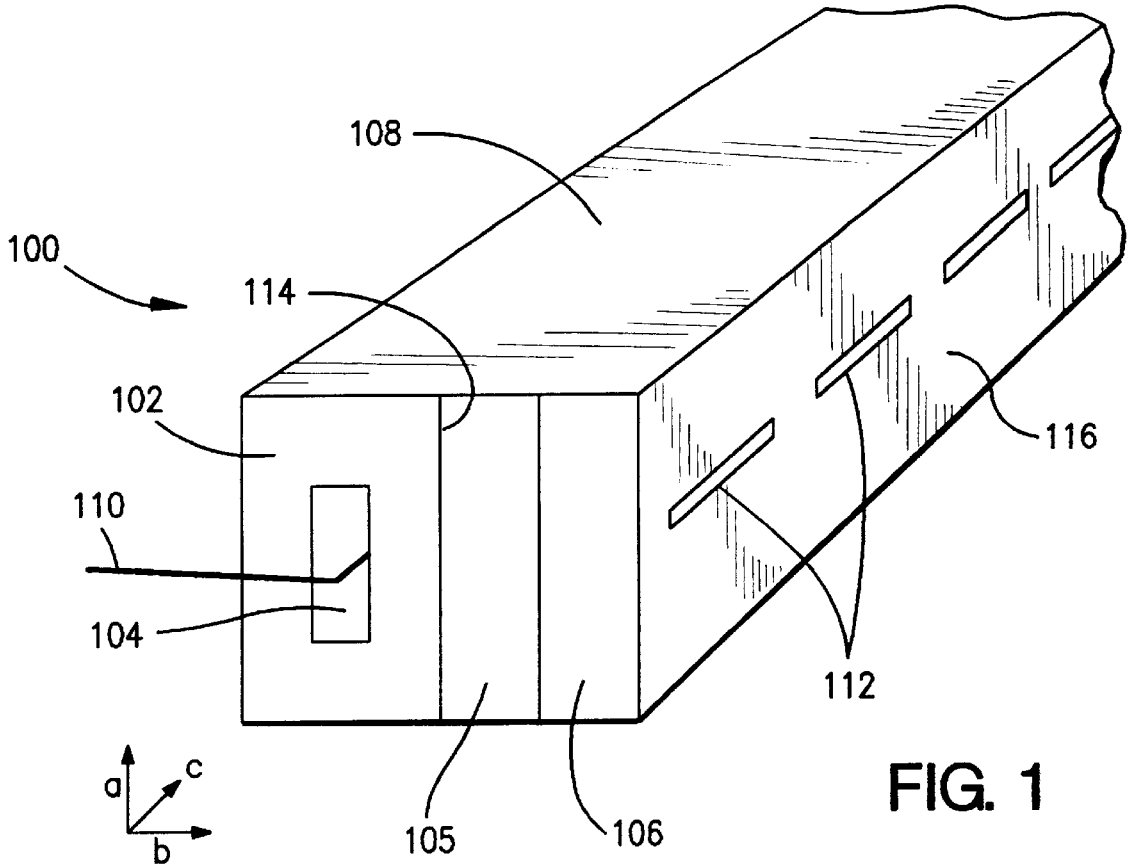
FIG. 1 is a perspective view of a partial illustration of a ferrite line source that is an embodiment of the current invention.

FIG. 1 shows a portion of a ferrite scanning line source 100 that is one embodiment of the present invention. The line source includes a rectangular ferrite toroid 102 having a rectangular cavity 104 extending the length of the toroid, and a pair of dielectric slabs 105, 106 attached to a side wall 114 of the toroid. The line source 100 is conceptually a non-reciprocal hybrid mode phase shifter, such as are disclosed in U.S. Pat. Nos. 5,170,138 and 5,075,648, that are both incorporated by reference. The line source is a linear phase shifter that advances or retards the phase angle of a signal propagating through the line source waveguide. A conductive metal skin 108 covers four sides (but not the ends) of the line source. A magnetizing latch wire 110 extends through the length of the cavity 104 and applies a current that sets the magnetic state of the toroid 102. The dielectric constant of the first slab 105, the one nearest to the toroid, is relatively high, e.g., $\in'=30$ to 100, to ensure efficient operation of the phase shifter 102. The dielectric constant of the second slab 106 is relatively low, e.g., $\in'=3$ to 16.

The particular dimensions of a ferrite scanning line source will generally depend on the particular application and frequency. Consistent with the embodiment shown in FIG. 1, a particular line source has been designed for a Ku-band (15 GHz) antenna system. The ferrite toroid 102 is formed of lithium ferrite and has a dielectric constant of ($\in'$) of 15.2. The outer dimensions of the rectangular waveguide are 0.075 inch (in.) height (b) and 0.121 in. width (a). The walls of the toroid are 0.020 in. thick. The length of the toroid depends on the number of slots and the spacing between slots. The toroid 104 has a height dimension of 0.075 in. and a width dimension of 0.080 in. The first dielectric slab 105, immediately adjacent the front wall of the toroid, has a dielectric constant ($\in'$) of 55, and a height (b) of 0.075 in. and width (a) of 0.026 in. The second dielectric slab 106, adjacent the first dielectric slab, has a dielectric constant ($\in'$) of 9.5, and a width (a) of 0.015 in. and height (b) of 0.075 in. Both dielectric slabs extend the entire length of the toroid, and the first slab 105 covers a side of the toroid. The outer surfaces of the line source are covered with a metal conductive skin 108 that forms the waveguide boundry. The coupling slots 112 in the front face 116 of the second slab are the only breach in the metal skin of the line source. The slots are etched regions on the metalized front face 116 of the line source. The slot dimensions are a function of the coupling value desired. For a 9.4 dB coupling valve, the slot dimensions would be 0.010 in. by 0.014 in.

Each slot can act as an individual RF radiator (or receptor) of the RF signal or as a coupler to another component. Slots 112 are etched into the front face 116 of the outer metalized surface of the second slab. The slots are parallel to the axis of the waveguide and are transverse to the currents in the wall 116 of the waveguide which are induced by the H field of the signal propagating through the waveguide. High frequency energy radiates from these slots to form a beam or to couple the slot to another device. The slots are formed by etching away the metal plating which covers the dielectric slab. The distance between slots may or may not be uniform, and the slot dimensions may be adjusted to achieve a desired coupling factor which will shape the radiation beam pattern. The phase of the signal is shifted (advanced or retarded) by the magnetization of the ferrite toroid. The degree of the phase shift increases as the signal propagates through the waveguide.

When used to radiate to free space, the slots provide a coupling between free space and the waveguide in that signals in the waveguide are injected into or extracted from the waveguide by the slots at intermediate locations along the length of the waveguide. At each slot, the phase of the signal is shifted from the phase at the preceding slot. Because of the phase shift between each slot, the wave front of the combined beam formed of all of the signals from the slots can be electronically tilted by an angle, the scan angle ($\psi$), related to the phase shift change from slot to slot.

Figure 2:
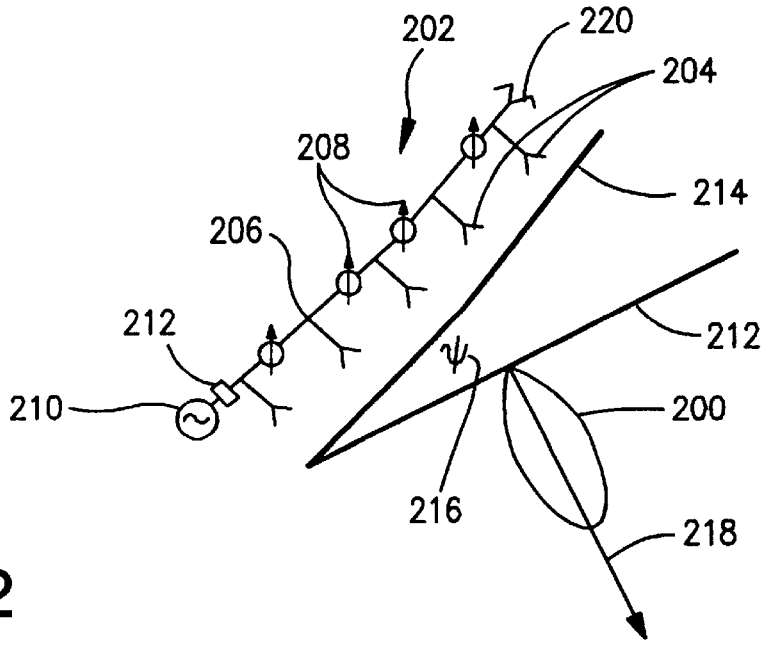
FIG. 2 is an exemplary transmitted beam pattern for the ferrite line source shown in FIG. 1.

FIG. 2 shows schematically a beam 200 emitted from a column 202, which may be a ferrite scanning line source 100 as shown in FIG. 1. Each slot 112 in the line source is represented in FIG. 2 as a radiator 204, and the waveguide is represented by an in-line series 206 of individual phase shifters 208 located between each of the radiators. In actuality, the phase shifters are not discrete devices and the individual phase shifters shown in FIG. 2 are merely functional representations of the phase shift that gradually occurs as the signal propagates through the waveguide 102.

At one end of the line source 202 is a signal generator (or receiver) 210 that generates signals to be transmitted from the slots. The generator is coupled to the waveguide by, for example, the pin probe or ribbon coupling shown in U.S. Pat. Nos. 5,075,648 and 5,170,138. While the generator is shown as being fed into one end of the line source in FIG. 2, the generator (signal source or receptor) could also be fed to the center of the line source, or even at some other intermediate location of the line source. An impedance matched termination load 220 is located at the other end of the column 202, opposite to the signal generator 210, to absorb any RF energy remaining after the last coupling slot.

Due to the phase differences of the signal radiated from each slot 204, the wave front 212 is tilted from parallel 214 to the column 202. The wave front would be parallel to the line source if all signals at each radiator were in phase. The beam propagation direction 218 is normal to the wave front. The scan angle and beam propagation direction (or direction from which a beam transmission is optimally received) may be changed by increasing or decreasing the phase shifts imparted to the signal by the line source 202. In particular, the beam is scanned (swept through the arc of the scan angle 216) by changing the remanent magnetization of the ferrite toroid which changes the phase shift that occurs between each of the slots.

For example, the scan angle ($\psi$) 216 can be cyclically scanned from +20° to 0° to −20° by repeatedly changing the current applied to the ferrite toroid by the latch wire. A current pulse applied to the latch wire 110 sets the magnetic state of the ferrite toroid 102. The latch wire is adapted to receive a voltage-time integral signal which may be represented by:

$$\phi = \int_{t1}^{t2} U dt$$

where $t_1$ and $t_2$ represent the start and stop time of the signal, U is voltage and $\phi$ is the desired magnetic flux setting.

The toroid will retain, i.e., latched, the magnetization state when the current pulse is over. The toroid must be reset before setting the new beam position. Moreover, the beam may be latched into a given direction, e.g., +20° to 0° to −20°, in space such that the beam will remain latched in a given direction until the magnetization of the toroid is changed. Controlling the toroid to set a given magnetization is explained in commonly assigned U.S. Pat. No. 4,445,098, which is incorporated by reference.

In the embodiment shown in FIG. 1, the coupling to free space from the ferrite line source is due to the favorable current density at the side wall 116 of the waveguide. The energy radiating from each slot is due to a voltage difference across each slot that results from the currents at the slot. These wall currents are the result of the H field of the signal at the waveguide walls. Current flows normal to the H field. Current density ($J_s$) is related to the H field as: $J_s$=n X H, where n is a normal vector to the waveguide surface. Accordingly, the voltage induced across the slot varies with the geometry and orientation of the slot, and with the current at the waveguide wall which in turn varies with the H field.

Figure 3A:
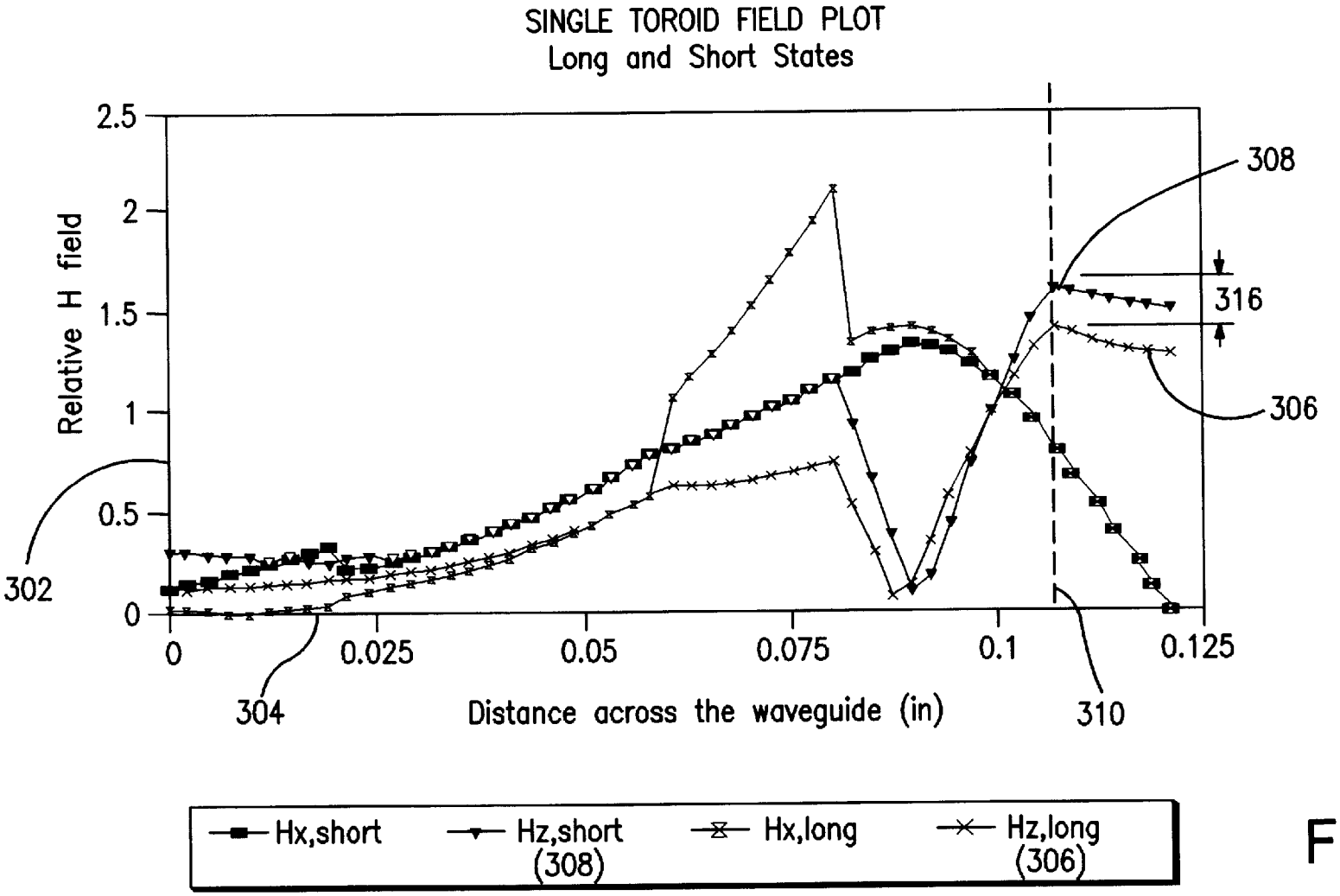
FIG. 3A is a chart of the H field strength across the waveguide for a single toroid, two dielectric slab embodiment of a ferrite line source.
Figure 3B:
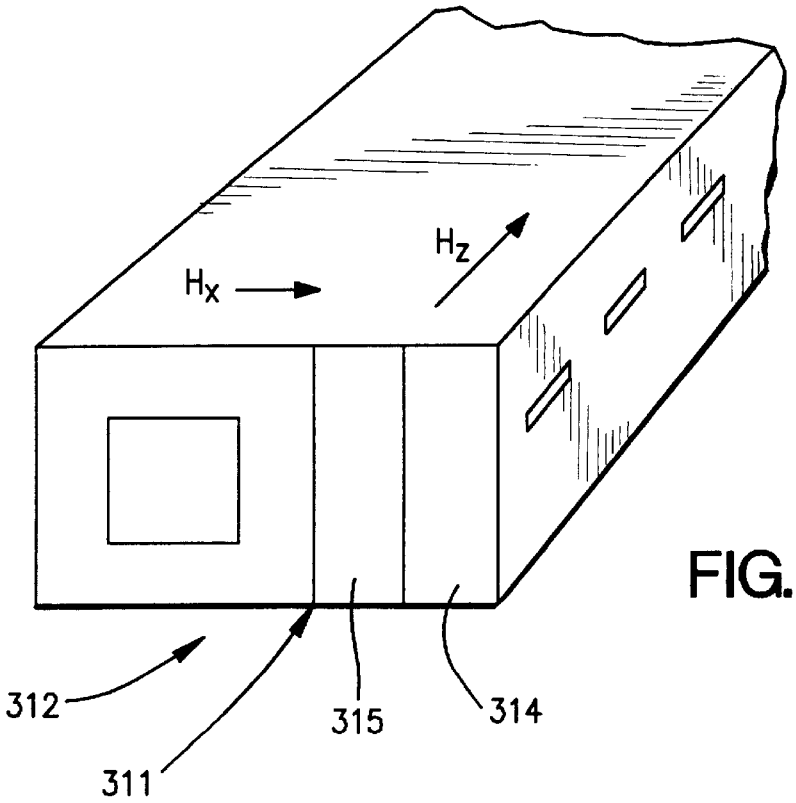
FIG. 3B is a diagram of a ferrite line source for which the performance is shown in FIG. 3A.

The line source geometry shown in FIG. 1 is advantageous because the H field at the side wall 114 adjacent the outer surface of the dielectric slab 106 is relatively high. Because of the high H field at the side wall, the coupling between the line source signal and slot radiation is strong. FIG. 3A is a chart showing the relative RF H field strength (ordinate 302) at different locations across the width of the waveguide (abscissa 304) for extreme magnetization states 306, 308 when one (1) watt of RF power is applied top the line source. FIG. 3B relates to line source 312 having two dielectric slabs 314 and 315 the performance of which is shown in FIG. 3A.

As evident from FIG. 3A, the H field is strong at the side wall 311 and does not vary significantly with magnetization state at the side wall. For the dual slab embodiment, there is only a 0.45 dB (20 log $H_{zls}/H_{zss}$) variation 310 in the H field strength at the waveguide side wall (i.e., at the interface between the waveguide and dielectric slabs 314, 315) as the magnetization state of the waveguide changes from being latched to an extreme electrically long state $H_{zls}$ (shown by the solid line 306) and to an extreme electrically short state $H_{zss}$ (shown by the dotted line 308). An $H_z$ field variation of 0.45 dB should be acceptable for most antenna applications, and this variation may be further reduced by design. The two dielectric slab design has a lower insertion loss than the single dielectric slab design for the same differential phase shift requirement.

The dimensions of the slots 112 (FIG. 1) in a ferrite line source should be selected based on the coupling value (ratio of energy radiated from slot to energy in the line source at the slot) needed for a particular design and other parameters of the design. Generally, the size of the slots 112 affects the degree of coupling from the line source to free space or other component, and the phase shift of the signal through the slot. Wide slots tend to have a higher coupling value than do thin slots. But, the phase shift is more frequency dependent with wide slots than with thin slots. For example, it has been predicted that a ferrite line source as shown in FIG. 1 having rectangular slots 0.12 in. long and 0.014 in. wide will have a coupling ratio of about −8.5 dB for frequencies under 15 GHz, and the coupling rolls off for higher frequencies (e.g., −8.9 dB at 19 GHz). The wavelength of the wave in the ferrite line source is substantially less than the free space wavelength, and in one embodiment the wavelength is one third that of the free space wavelength.

While the coupling value remains relatively uniform for changes in frequency for thinner slots, the coupling value is reduced. For the embodiment shown in FIG. 1 having slots 112 that are 0.140 long (c) and 0.010 in. wide (a), the predicted coupling values are approximately −9.4 dB. For slots 0.140 in.×0.08 in., the predicted coupling valve is −11.6 dB, and −15.5 dB for slots 0.140 in.×0.06 in. These predicted values are for frequencies from 14 GHz to 19 GHz. Moreover, the phase shift that occurs through each slot varies with the coupling value. For the embodiment shown in FIG. 1, the predicted phase shift for a signal transversing the coupling slot at a frequency of 15 GHz is: −17° for a coupling value of −8.5 dB; −24° for a coupling value of −9.4 dB; −30° for a coupling value of −11.6 dB, and −35° for a coupling value of −15.5 dB.

In addition, the lower the coupling value, the greater the coupling slot phase shift increases with increasing frequency. For example, the phase shift through the slot is relatively uniform for a coupling values of −8.5 dB and −9.4 dB for frequencies between 14 GHz and 19 GHz, respectively. For lower coupling values, e.g., −11.6 dB and −15.5 dB, the phase shift becomes gradually greater as the frequency increases. To compensate for the phase shift variations, it may be necessary to adjust the spacing between slots 112. For designs in which the slots are coupled to a microstrip, the microstrip line or a tuning stub adjacent the slot can be designed to compensate for variations in the phase shift. Moreover, the use of a center signal inlet to a ferrite line source should reduce the amount of phase shift variation because the coupling values are more uniform.

Figure 4:
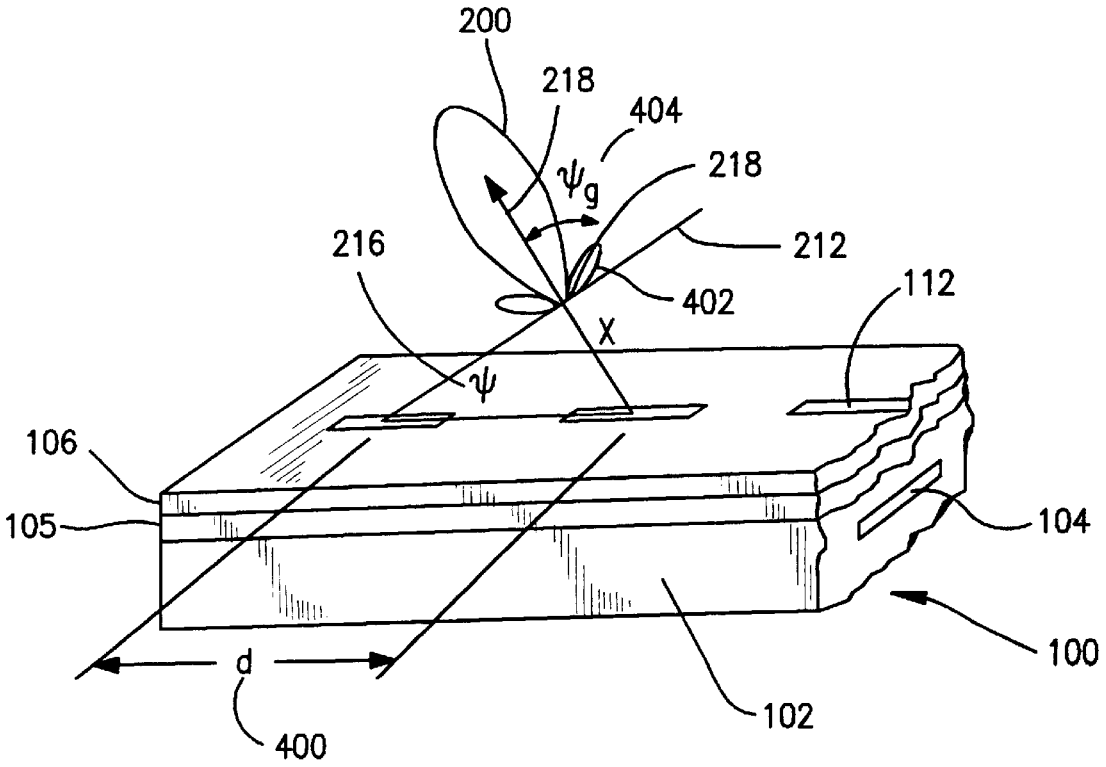
FIG. 4 is a top perspective view of a partial illustration of the ferrite line source shown in FIG. 1.

FIG. 4 shows the relationship between the scan angle ($\psi$) 216 and the distance (d) 400 between slots 112 in a ferrite scanning line source 100. The amount of scan (variation in the scan angle) is limited by the extent of the phase change that occurs between slots. The phase change, i.e., shift, between slots is proportional to the distance (d) between the slots. To maximize the phase shift between slots, the distance between slots should be increased to the extent practical. The distance between the slots is limited by the grating lobes 402 (extraneous lobes of the transmission beam) that occur with any array antenna design when the element spacing is greater than 0.5 $\lambda$. A grating lobe (a grating lobe is substantially equal in amplitude to the main beam and reduces the amplitude of the main beam by 3 dB) will exist whenever a beam is scanned to a particular scan angle ($\psi$) 216 if the distance between slots (d) is too large. The maximum distance (d) needed to eliminate a grating lobe can be calculated by the following equation:

$$d = \frac{\lambda o}{1 + \sin\psi g}$$

Where, d=slot spacing; $\lambda_0$=free space wavelength of transmission (or reception) $\psi$g=scan angle at which a grating lobe will exist.

If the intended scan angle is ±20°, a grating lobe will not exist for scan angles within ±30°, if d=0.67 $\lambda_0$. The differential phase shift ($\Delta\phi$) that must be imparted to the waveguide signal by the ferrite toroid between each slot for a selected scan angle is given as follows:

$$(\Delta\phi)=(K)(d)\sin(2\psi)$$

Where K is the propagation constant for free space and $2\psi$ represents the total arc through which the beam will be scanned.

The propagation constant (K) is given as $(2\pi/\lambda_0)$, therefore, the equation for the requisite differential phase shift reduces to:

$$(\Delta\phi)=(2\pi)(0.67)\sin(2\psi)$$

$$(\Delta\phi)=241\sin(2\psi)(\text{degrees})$$

Where the scan angle ($\psi$) equals ±20°, the requisite differential phase ($\Delta\Phi$) is 155°.

In addition, the slot spacing along the ferrite line source should be close to $n(\lambda_f)$, where n is an integer and $\lambda_f$ is the signal wavelength in the line source. The integer (n) should be kept small, e.g., 2, to provide good frequency response. Moreover, the ratio of the free space wavelength ($\lambda_0$) to the line source wavelength ($\lambda_f$) in one embodiment of the invention is three (3). For this embodiment, where the slot spacing (d) is equal to 0.67 of the free space wavelength ($\lambda_0$) and n=2, the distance between slots is preferably 2 $\lambda_f$. The value of (d) can be adjusted to optimize the phase shift between slots in the ferrite line source and minimize difficulties with grating lobes. In addition, the line source may be tilted to avoid scanning through broadside (where wavefront direction is normal to the plane of the array face). This tilt in the line source may require an adjustment of the slot spacing (d) to achieve the desired beam position.

Given that the free space wavelength ($\lambda_0$) is 0.79 in. for a 15 GHz Ku-Band signal and the desired scan angle ($\psi$) is 20, the slot spacing (d) is equal to 0.67 $\lambda_0$ which in turn converts to 0.53 in. The differential phase per inch is the differential phase obtained for one (1) inch of line source length. For this embodiment, the differential phase ($\Delta\Phi$) per inch necessary to scan ±200° is (155°/0.53 in.) is 292° per inch. The embodiment produces a differential phase ($\Delta\Phi$) per inch of 350°, which is more than that required to scan ±20°. Moreover, the differential phase ($\Delta\Phi$) per inch can be further increased by increasing the inter-dielectric slab dielectric constant, but to do so could increase the insertion loss of signals injected into the waveguide to unacceptable levels.

Figure 5:
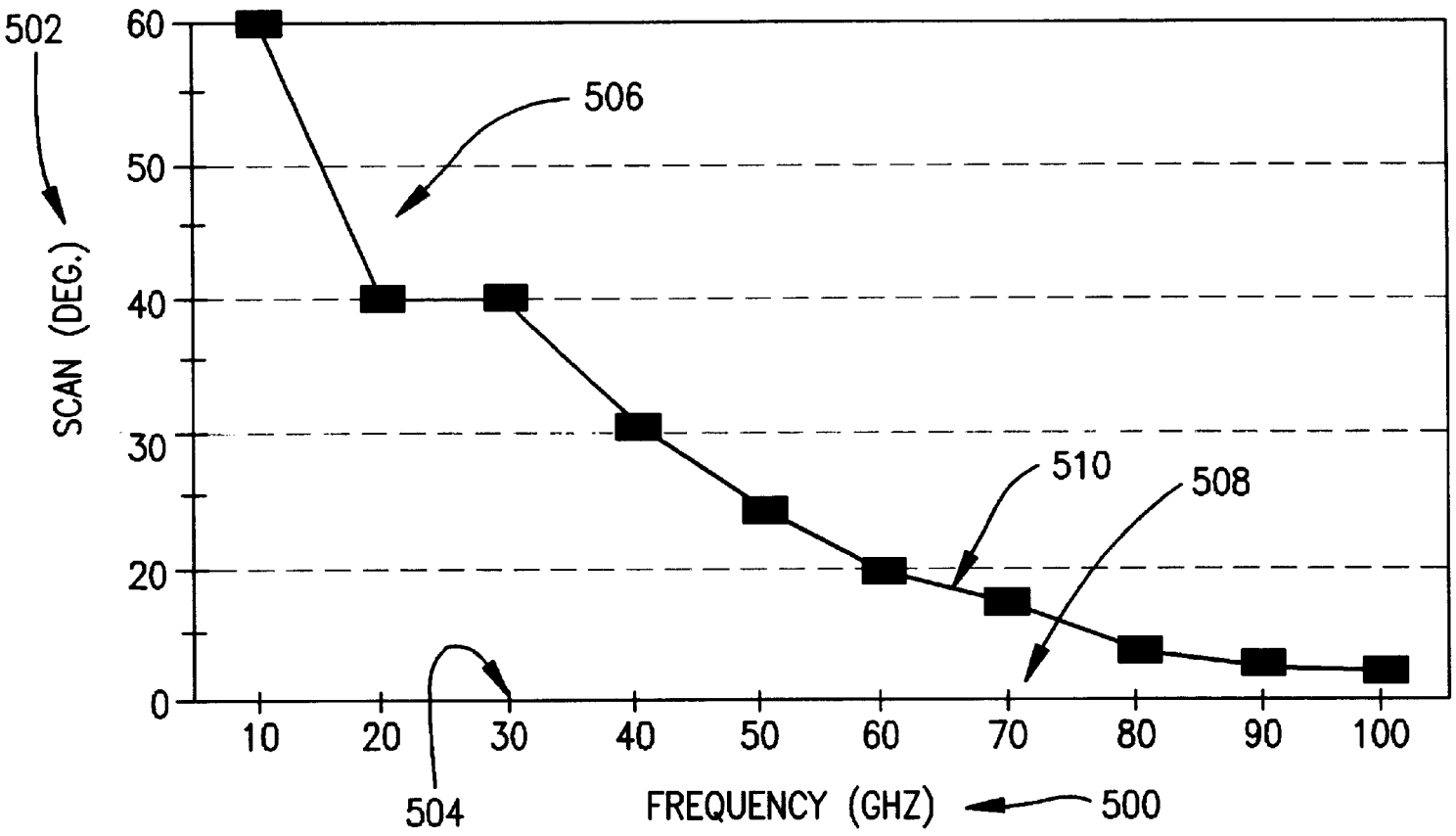
FIG. 5 is a chart illustrating the relationship of scan coverage obtainable as a function of operating frequency for the embodiment of the invention shown in FIG. 1.

For lower frequency signals, such as at X-Band and below, higher dielectric constant dielectrics can be used without a significant increase in the signal insertion loss. This is because the loss tangents of the high dielectrics are lower at the lower frequencies. Larger scan angles, e.g., greater than ±20°, can be obtained with the ferrite line source. FIG. 5 shows a chart comparing signal frequency 500 to the predicted scan angle 502 for the electronically scanned ferrite line sources that embody the current invention. At relatively low frequencies, such as less than 30 GHz (504), scan angles (506) of 40° and greater may be achieved. While at relatively-high frequencies (508), such as above 60 GHz, the maximum scan angles (510) are 20°, and less. FIG. 5 indicates a flat portion of the curve between 20 and 30 GHz which is due to a lack of dielectric material availability.

Figure 6:
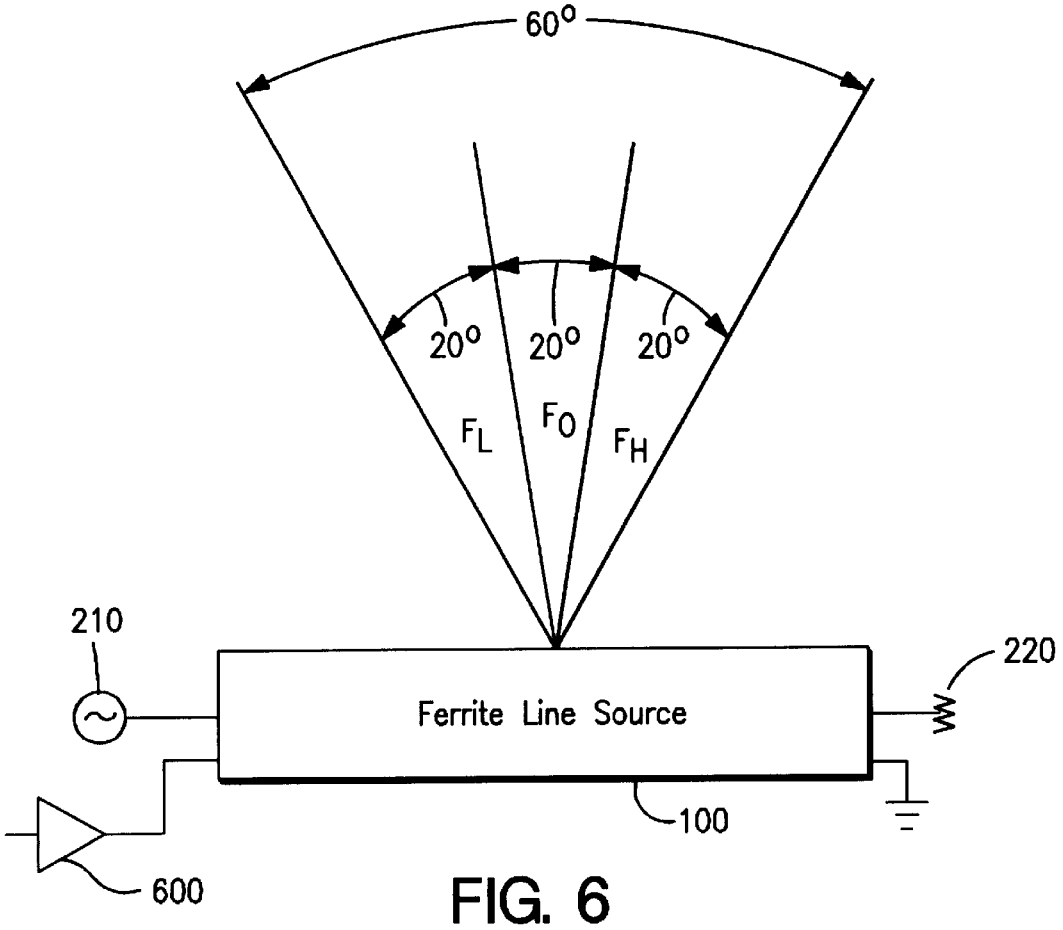
FIG. 6 is a schematic diagram of an electronically scanned ferrite line source that combines frequency and phase scanning to increase the amount of scan coverage.

To obtain wider scan angles that are available by phase shifting alone, a technique has been developed of combining phase scanning and frequency scanning with the ferrite line sources that embody the current invention. As shown in FIG. 6, a ferrite line source 100 is excited with a low frequency signal ($F_L$), and center ($F_c$) and high ($F_h$) frequency signals. A signal source selectively controls which signal (low ($F_L$), center ($F_c$) or high ($F_h$) frequency signal) is applied. The amount of phase shift that occurs between slots in the waveguide varies significantly as the signal frequency changes between the low, center and high frequency signals. The sensitivity of the phase shift to the signal frequency is directly related to the dielectric characteristic of the line source, and a ferrite line source having a high dielectric characteristic is desirable for practical frequency induced beam scanning. For example, it has been calculated that for low, center and high frequency signals (e.g., 15, 16.3 and 17.7 GHz, respectively), the change in frequency would cause the beam to step in 20° increments as is shown in FIG. 6. This 20° shift in the beam that can be achieved with frequency stepping may be supplemented with phase scanning to scan the beam between each of the 20° arc steps achieved with frequency scanning. By combining frequency and phase scanning, a beam emitting from the line source can be scanned through, for example, a 60° arc, as is shown in FIG. 6.

Figure 7:
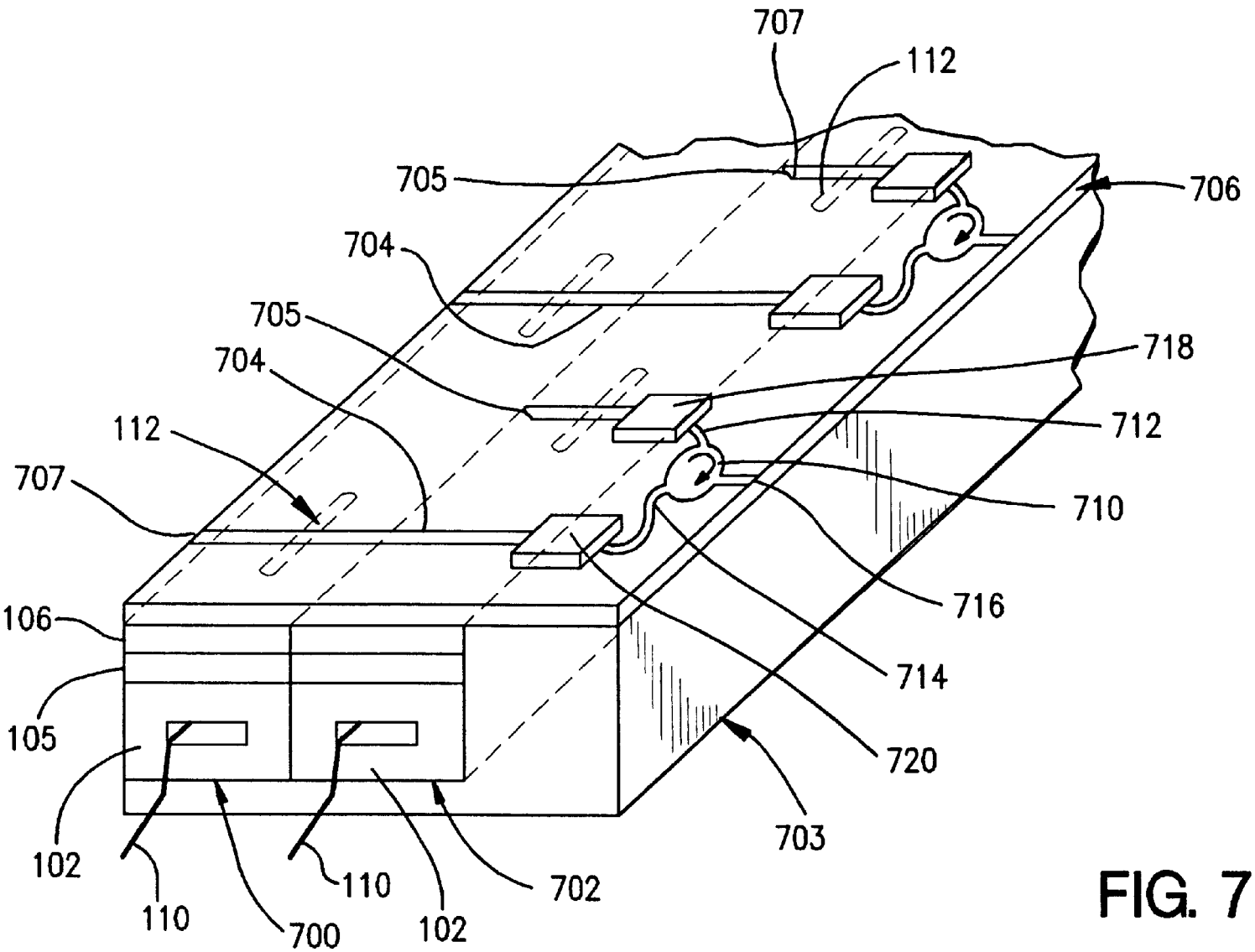
FIG. 7 is a perspective view of a portion of a reciprocal active embodiment in which a pair of ferrite line sources are coupled by a circulator and solid state amplifier to the antenna aperture elements.

FIG. 7 shows a portion of another embodiment of the invention in which a pair of electronically scanned ferrite line sources 700, 702 are coupled to an antenna radiating element (not shown) by microstrip lines 704. The pair of line sources are mounted in parallel in a supporting structure 703 which is electrically isolated from the line sources by their respective metal skins. Instead of directly radiating to free space, the slots 112 in each of the line sources 700, 702 are coupled to microstrip lines 704, 705 that overlie the slots and are orthogonal to the slots. The microstrip lines extend beyond the slots to provide a tuning stub 707 for the coupling with the slot. A planar microstrip substrate 706 covers the slots 112 of both line sources 700, 702, and the planar microstrip substrate 106 has a slot in the ground plane which aligns with the slotted metalization of the line sources.

The first line source 702 of the two line sources is used to transmit signals and the second line source 700 is used to receive signals. While a single line source (such as shown in FIG. 1) can be switched in a few microseconds from transmit to receive, or receive to transmit, this switching must be accomplished to transmit and receive to and from the same beam direction in space. The pair of line source configuration shown in FIG. 7 eliminates the need for switching between transmit and receive. For some applications, it may be desirable to transmit at one beam direction and receive from another beam direction. By using a pair of line sources as shown in FIG. 7, the beam directions can differ between transmit and receive, if desired. In addition, the pair of line sources 700, 702 can be designed such that the amplitude distribution for transmission and reception are optimized for different gain and sidelobe requirements.

Each microstrip (or strip line) 704, 705 is connected to a three-port duplexing circulator 710, such that a first port 712 is connected to the microstrip 705 coupled to the slotted transmission line source 702, the second port 714 is connected to the nicrostrip 704 that is coupled to the slotted reception line source 700, and the third port 716 is connected to a microstrip coupled to a radiating element (not shown). Signals to be transmitted are fed to the transmission line source 702, and successive phase shifted transmission signals are extracted from each of the coupling slots 112 to the microstrip 705, and routed through a respective circulator 710 to a respective antenna element of an phased array antenna. Similarly, signals received by the antenna are collected by each of the antenna elements and routed through the circulators 710 to a respective slot 112 in the receiver line source 700.

In addition to the passive elements discussed above with respect to FIG. 7, the embodiment may be supplemented with active elements such as high power amplifiers 718, and low noise amplifiers with transmit/receive limiters 720. The high power amplifiers 718 are activated when a signal is fed to the transmit line source 702 and amplify each of the phase shifted signals being routed to the antenna elements in the antenna array. Similarly, the low noise amplifier (LNA) 720 is active whenever there is no transmission. The limiter is necessary to protect the LNA from the transmit pulse, or any other high power spurious signal arriving at the antenna elements. The antenna radiating elements could be simple microstrip radiators which are inexpensive and small, or more elaborate radiating elements.

Figure 8:
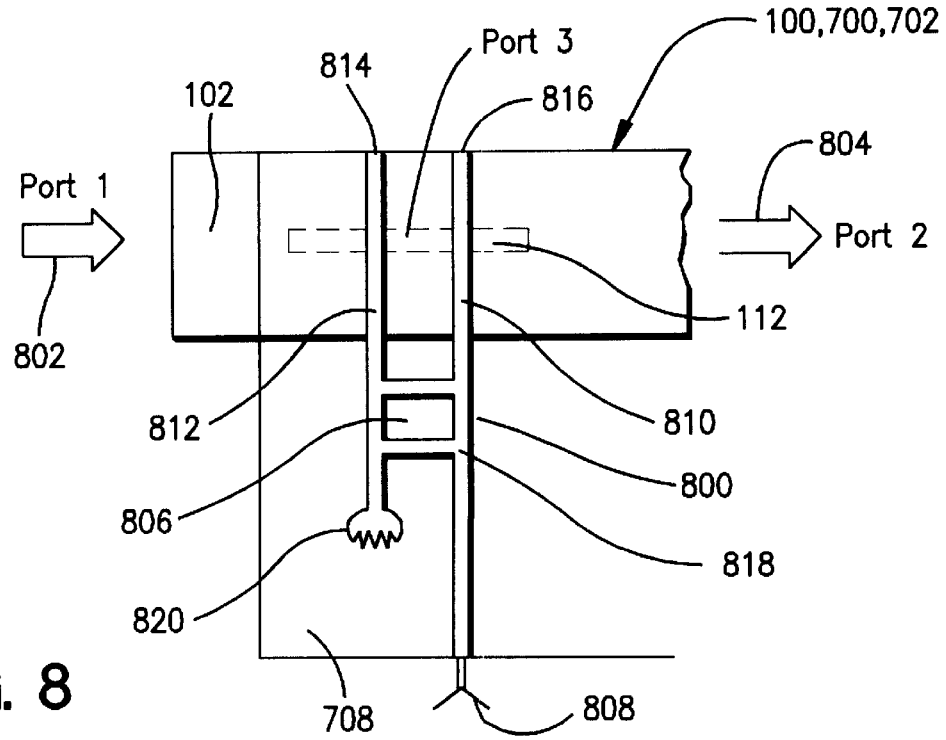
FIG. 8 is an enlarged view of a circuit to eliminate the multiple reflections between an aperture and a coupling slot of a ferrite line source embodiment of the present invention.

FIG. 8 shows a ferrite line source (either 100, 700 or 702) and microstrip interface 800 with designations for Port 1 802, Port 2 804 and Port 3 (slot 112). A flndamental principle of three port networks is that the three ports cannot be all impedance matched. Accordingly, Ports 1 and 2 (within the waveguide) are matched at the expense of the slot coupler (Port 3) 112. Typical values of return loss for Ports 1 and 2 are greater than 20 dB which minimizes reflective waves propagating through the waveguide 102. There is the potential for a substantial signal reflection at the coupling slot (Port 3) which has a signal return loss of only approximately 4 dB. The impedance mismatch at the slots (Port 3) tends not to interfere with the signal propagating in the waveguide as any signal reflections from the slots that feed into the waveguide is canceled by the similar (but out of phase) reflective signal(s) from one or more of the other slots.

The impedance mismatch at the slot 112 may cause problems due to an aperture mismatch. A signal reflected from the aperture will be again reflected at the coupling slots back toward the aperture. These reflected signals will ultimately be radiated from the antenna element at some unknown phase angle and deteriorate the desired beam pattern. A way to minimize the microstrip line reflections due to the slot/aperture mismatch is to position a 90° hybrid 806 between the antenna element aperture 808 and the slot 112. A reflection coming from the antenna aperture 808 toward the slot 112 is split by the 90° hybrid between a pair of microstrip lines 810, 812 into two −3 dB signal reflections. Each −3 dB reflection is 90° out of phase with the other −3 dB reflection. After these half-power reflections reflect off of the respective stubs 814, 816 of each microstrip they again pass through the 90° hybrid 806. At the aperture port 818 the two signals are 180° out of phase with each other and cancel. At the load 820 the reflections are in phase but are dissipated by the load. Accordingly, signal reflections from the slot 112 are not radiated from the antenna element 808. It is not necessary that the hybrid be precisely 3 dB. Good results can be achieved with other coupling values by placing tuning elements between the hybrid 806 and the output port 808.

Signals from the line source 102 are coupled through the slots 112 onto the microstrips 810, 812. Due to the positioning of the microstrips 810, 812 at opposite ends of the coupling slot 112, the signals from the line source coupled to the two microstrips are 90° out of phase from one another. If the delta phase at the coupling slots is not 90°, it can be adjusted to be so by adjusting the transmission line lengths on the substrate. After one of these two signals (on strip 814) pass through the 90° hybrid 806, the signals are aligned in phase and sum at the aperture port 818 of the network. At the load port 820, the signals are 180° out of phase and cancel. Accordingly, for transmission of signals from the line source, signals are coupled from the line source through the slots 112 onto the microstrips sum together when they reach the antenna aperture 808. Any signal reflections from the aperture and the slots will be dissipated at the load 820. Similarly, during reception of signals through the antenna aperture, signal reflections from the slots 112 are absorbed at the load 820 due to the amplitude and phase relationships of the reflected signals.

Figure 9:
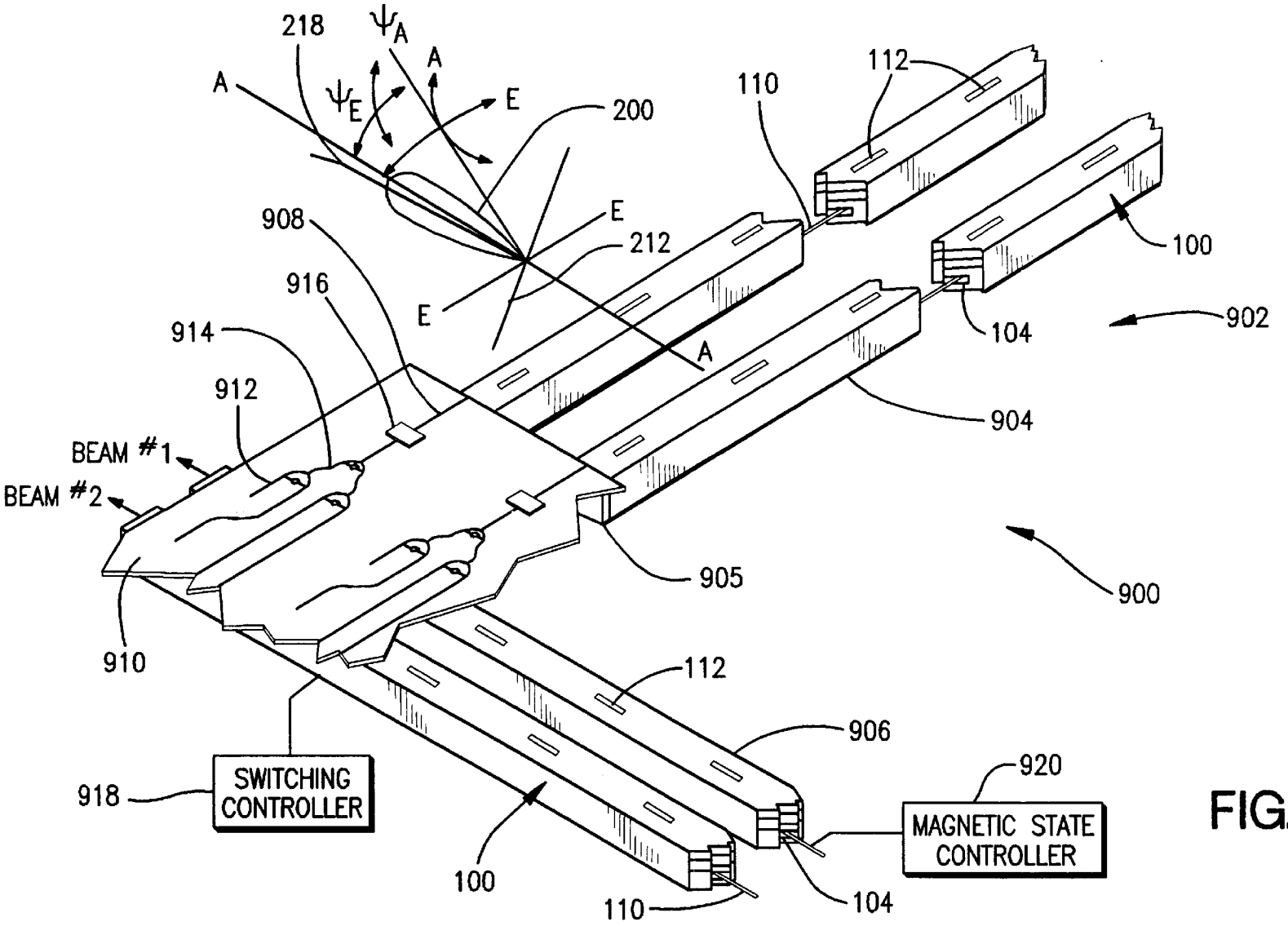
FIG. 9 is a perspective view of a third embodiment in which a plurality of elevation scanning line sources are coupled by microstrip lines to a plurality of azimuth scanning line sources.

FIG. 9 is a perspective view of a multiple beam antenna system 900 formed of an antenna array 902 of slotted ferrite line sources 904 (only two are shown but there may be more) that are coupled to a plurality of azimuth ferrite line sources 906 (only two are shown but there may be more). The two sets of lines sources 904, 906 are coupled by a series of microstrip lines 908 on a microstrip substrate 910. One set of line sources 904 are used for elevation scanning of a beam(s) and the set of line sources 906 are used for azimuth scanning of a beam(s). Each line source 902, 906 may be similar to the line source shown and described in connection with FIG. 1. Latch wires 110 extend through each line source 104 and are electronically controlled to set the magnetic state for its respective toroid and change the differential phase shifts between the waveguide signals that are extracted from each of the slots 112.

The columns of elevation (E—E) scanning line sources 902 that form the antenna array 902 are aligned vertically to the horizon and each of the slots 112 receive energy that collectively forms a beam 200 from the antenna array along a wave front 212. By changing the magnetic state of the toroid 104 in the antenna array 902, the elevation (E—E) of the beam direction 218 may be scanned through the elevation scan angle ($\pm\psi_E$) provided by the elevation line sources 904.

The columns of elevation line sources 904 in the antenna array 902 each receive signals and form the elevation beam. Each of the azimuth line sources 906 receives a signal, e.g., beam #1 and beam #2, from the elevation line source, and forms the azimuth beams. The azimuth beams may be scanned independently by each of the azimuth line sources. The LNA is used here to set the noise figure, and therefore the loss through the power dividers and azimuth line sources are not critical. The transition 905 between the microstrip 908 and the line source 904 may be accomplished with a pin probe or a ribbon coupling, such as those shown in U.S. Pat. Nos. 5,075,648 and 5,170,138.

The antenna network shown in FIG. 9 can produce simultaneous scanning beams. For each beam, the entire aperture is used to obtain the desired beam width and gain (aperture re-usage). Of course, the power divider shown could be replaced with a switch, and therefore, beam switching in azimuth could be obtained.

Figure 10:
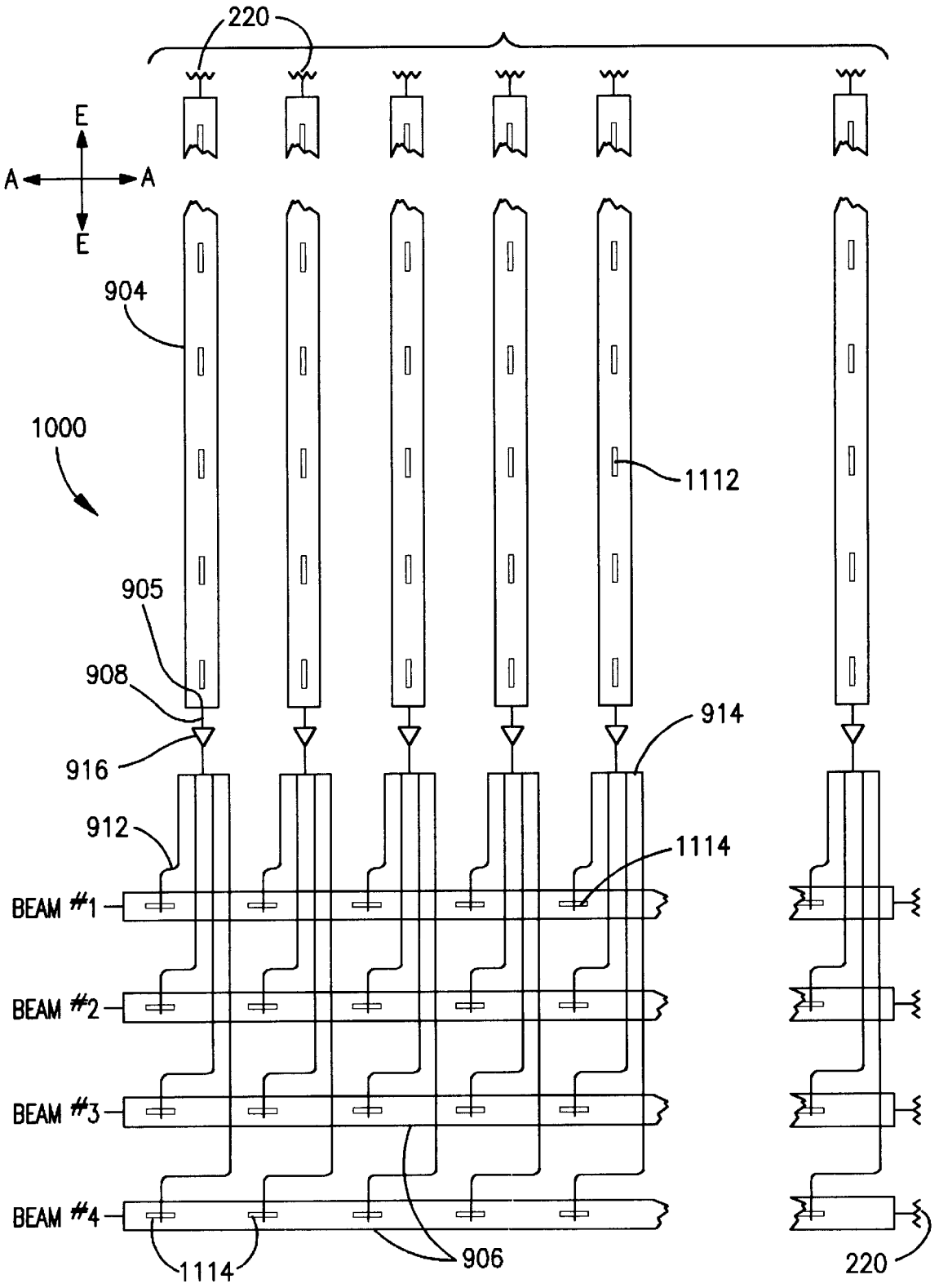
FIG. 10 is a schematic for a fourth embodiment of the invention which comprises a multiple beam antenna formed of electronically scanned ferrite line sources.

FIG. 10 shows a schematic diagram of a particular implementation of a multi-beam antenna system 1000 for receiving signals, such as that shown in FIG. 9. The elevation line sources 904 are arranged as columns in a planer array to form a phased array reception antenna. The number of elevation line sources 904 depends on the intended width in the azimuth (A—A) plane of the beam(s) to be received. Each of the radiating slots 1112 in the elevation line sources receives energy from free space. The number of slots 1112 depends on the desired width in the elevation (E—E) plane of the beam(s) to be received. Each line source has an impedance matched termination load 220 and a transition 905 that couples the received signal from the elevation line sources that are placed on microstrips 908 and fed to the respective azimuth line source waveguides 906. These received signals fed to the azimuth line sources are the respective signal beams (Nos. 1 to 4) received by the slots 1112 of the elevation line sources 904. The number of coupling slots 1114 in each of the azimuth scanning line sources is determined by the number of elevation line sources 904, as there must be one coupling slot in each azimuth line source for each elevation line source. The aperture slots 1112 and associated elevation line sources 904 transfer beam signals to a microstrip 908, and power dividers 916 that direct the respective beam signals to a network 914 of other branch microstrips 912 that lead to the azimuth line source 904. The network shown in FIG. 10 is for receive only as indicated by the LNA 16 associated with the power dividers 916, however, the network could be used for transmit as well, by removing the LNA.

The invention has been described in connection with the preferred embodiments. The invention is not to be limited to the disclosed embodiments, but rather includes the various modifications and equivalent arrangements included within the spirit and scope of the appended claims.

What is claimed is:

1. An electronically scanned ferrite line source comprising:

a linear waveguide having a hollow ferrite toroid, at least one dielectric slab external to the toroid and adjacent a first wall of the toroid, and a conductive skin covering outer surfaces of the toroid and slab; and a plurality of slots etched on the conductive skin adjacent the dielectric slab, where the slots are parallel to an axis of the waveguide.

2. An electronically scanned ferrite line source as in claim 1 wherein the slots radiate energy into free space.

3. An electronically scanned ferrite line source as in claim 1 having a latch wire extending through the ferrite toroid and said latch wire is adapted to receive a voltage time integral signal to selectably set the magnetic state of the ferrite toroid.

4. An electronically scanned ferrite line source as in claim 1 wherein said slots are rectangular and have a long dimension parallel to a longitudinal axis of the toroid.

5. An electronically scanned ferrite line source as in claim 1 wherein the toroid has a longitudinal cavity that is rectangular in cross section.

6. An electronically scanned ferrite line source as in claim 1 wherein the slots are spaced apart by a distance approximately twice the wavelength of a signal propagating in the line source.

7. An electronically scanned ferrite line source as in claim 1 wherein the dielectric slab is a composite slab formed of a plurality of dielectric slabs stacked together.

8. An electronically-scanned ferrite line source as in claim 7 wherein a first slab of said plurality of dielectric slabs is adjacent the first wall of the toroid and a second slab of said plurality of dielectric slabs is separated from the toroid by the first slab.

9. An electronically scanned ferrite line source as in claim 8 wherein the first slab has a dielectric constant relatively high as compared to a dielectric constant of the second slab.

10. An electronically scanned ferrite line source for spatially scanning a beam of electromagnetic energy comprising:

a linear waveguide having a hollow ferrite toroid, at least one dielectric slab external to the toroid and adjacent to a first sidewall of the toroid, and a conductive metal skin covering outer surfaces of the toroid and slab;

wherein a plurality of slot apertures are etched in the skin adjacent the dielectric slab, and the slot apertures are parallel to an axis of the waveguide;

an impedance matched terminal load for at least one end of the waveguide;

a signal port to the waveguide, and a current carrying latch wire extending through said toroid.

11. An electronically scanned ferrite line source as in claim 10 wherein the slot apertures etched on the metal skin radiate energy into free space.

12. An electronically scanned ferrite line source as in claim 10 wherein said latch wire is adapted to receiving a voltage-time integral signal and the voltage-time integral signal is represented by:

$$\phi = \int_{t1}^{t2} U dt$$

where $t_1$ and $t_2$ represent the start and stop time of the signal, U is voltage and $\phi$ is the desired magnetic flux setting.

13. An electronically scanned ferrite line source as in claim 10 wherein said slot apertures are rectangular in cross-section and have a long dimension parallel to a longitudinal axis of the toroid.

14. An electronically scanned ferrite line source as in claim 10 wherein the toroid has a longitudinal cavity rectangular in cross section.

15. An electronically scanned ferrite line source as in claim 10 wherein the slot apertures are separated by a distance approximately twice a wavelength of a signal propagating in the line source.

16. An electronically scanned ferrite line source as in claim 10 wherein the at least one dielectric slab is a pair of dielectric slabs stacked together.

17. An electronically scanned ferrite line source as in claim 16 wherein a first slab of said pair of dielectric slabs is adjacent the first sidewall of the toroid and a second slab of said pair of dielectric slabs is separated from the toroid by the first slab.

18. An electronically scanned ferrite line source as in claim 17 wherein the first slab has a dielectric constant relatively high as compared to a dielectric constant of the second slab.

19. An electronically scanned phase array antenna comprising:

an electronically scanned linear ferrite line source including:

a hollow ferrite toroid having a first wall;

at least one dielectric slab adjacent the first wall of the toroid, where the slab is external to the toroid;

a conductive skin covering outer surfaces of the toroid and slab;

a plurality of radiating slots etched on the conductive skin adjacent the slab and parallel to an axis of the toroid, wherein said slots radiate electromagnetic energy to collectively form a transmission beam propagating in a beam direction;

a latch wire for setting the magnetic state of the toroid, and a signal coupling port for receiving signals for transmission from the line source;

a signal generator for sequentially supplying a plurality of frequency beam signals, wherein each signal has a substantially different wavelength, and a signal and latch wire driver that sequentially applies each of the signals to the signal coupling port to change the beam direction from one scan angle to another, and sequentially sets the magnetic state of the toroid by applying current to the latch wire to further change the direction of the beam direction.

20. An electronically scanned phase array antenna as in claim 19 wherein the plurality of frequency beam signals includes a low frequency signal, a center frequency signal and a high frequency signal.

21. An electronically scanned ferrite line source antenna device for spatially scanning a beam of electromagnetic energy comprising:

a linear waveguide having a ferrite toroid, at least one dielectric slab disposed external to and adjacent a first sidewall of the toroid, and a conductive metal skin covering outer surfaces of the toroid and slab, wherein said skin includes coupling slots etched in a surface adjacent the slab;

an impedance matched terminal load for at least one end of the waveguide;

a signal port to the waveguide;

a current carrying latch wire extending through said waveguide;

a pair of microstrips coupled to each of the coupling slots where said microstrips are mounted on a substrate juxtaposed to a front face of an outer one of said dielectric slab, and each of said pair of microstrips are coupled to opposite ports of a 90° hybrid coupler, and each of said pair of microstrips extend beyond the hybrid coupler such that the first of the pair of microstrips terminates at a terminal load and the second of the pair of microstrips terminates at an antenna aperture.

22. An electronically scanned ferrite line source antenna coupling comprising:

first and second ferrite line sources each having a linear ferrite toroid and at least one dielectric slab adjacent a first wall of each toroid, and a plurality of coupling slots etched in a conductive skin covering the toroid and slab, where said first ferrite line source is adapted to be fed a signal for transmission for an antenna and said second ferrite line source is adapted to be fed a signal received by the antenna;

a microstrip substrate juxtaposed over the slots of each of said first and second ferrite line sources, wherein at least one microstrip is electromagnetically coupled to each one of said coupling slots, and each of said microstrip is connected to first or second port of a circulator and a third port of the circulator adapted to be coupled to an antenna radiating element.

23. An electronically scanned ferrite line source antenna coupling as in claim 22 wherein the first port of the circulator is coupled via one of said microstrip to the first ferrite line source and the second port of the circulator is coupled via a second one of said microstrip to the second ferrite line source.

24. A multibeam antenna system comprising:

an elevation array of electronically scanned ferrite line sources each having a linear waveguide having a ferrite toroid and, at least one dielectric slab adjacent an external surface of a side wall of the toroid, a conductive skin covering outer surfaces of the toroid and slab, and a plurality of radiating slots etched in the skin adjacent the slab to radiate signals in the waveguide out to free space;

an azimuth array of electronically scanned ferrite line sources each having a linear waveguide having a ferrite toroid and, at least one dielectric slab adjacent a side wall of the toroid, a conductive skin covering outer surfaces of the toroid and slab, and a plurality of coupling slots etched in the skin adjacent the slab to transfer beam signals fed into each of the waveguides to a coupling to the elevation array of electronically scanned ferrite line sources, wherein each slot in each of the azimuth ferrite line sources is coupled to a respective one of the elevation line sources.

25. A multibeam antenna system as in claim 24 wherein the coupling between the azimuth array and elevation array is a network of microstrips having a plurality of branches each coupled to a one of the coupling slots in the azimuth array, wherein said branches for each of the coupling slots corresponding to the respective one of the elevation line sources are combined to a coupling to the respective elevation line source.

* * * * *

UNITED STATES PATENT AND TRADEMARK OFFICE

CERTIFICATE OF CORRECTION

PATENT NO. : 5,955,998

DATED : September 21, 1999

INVENTOR(S) : Roberts, et al

It is certified that error appears in the above-identified patent and that said Letters Patent is hereby corrected as shown below:

In the Abstract, line 12, ""titled" should read --tilted--

Column 1, line 37, "valves" should read --values--

Column 3, line 66, "valve" should read --value--

Column 3, line 67, "0.010" should read --0.100--

Column 5, line 10, "latched" should read --latch--

Column 5, line 46 "310" should read --316--

Column 5, line 47, after "side wall" insert --310--

Column 6, line 12, "0.140 long (c) and 0.010 in. wide (a)" should read --0.100 long (c) and 0.014 in. wide (a)--

UNITED STATES PATENT AND TRADEMARK OFFICE

CERTIFICATE OF CORRECTION

PATENT NO. : 5,955,998
DATED : September 21, 1999
INVENTOR(S) : ROBERTS et al

It is certified that error appears in the above-identified patent and that said Letters Patent is hereby corrected as shown below:

Column 6, line 13, "0.140 in X 0.08 in." should read --0.014 in X 0.08 in." and "valve" should read --value--

Column 6, line 14, "0.140 in X 0.06 in." should read --0.014 in X 0.06 in.--

Column 7, line 37, "±200°" should read --±20°--

Column 8, line 56, "nicrostrip" should read --microstrip--

Column 9, line 17, "fIndamental" should read --fundamental--

Column 10, line 54, "planer" should read --planar--

Column 11, line 11, "LNA 16" should read --LNA 916--

Column 11, line 12, "dividers 916" should read --dividers 914--

Signed and Sealed this

Twenty-third Day of May, 2000

*Attest:*

Q. TODD DICKINSON

*Attesting Officer*

*Director of Patents and Trademarks*